US011192688B2

(12) United States Patent
Herlin et al.

(10) Patent No.: US 11,192,688 B2
(45) Date of Patent: Dec. 7, 2021

(54) PACKAGING CONTAINER WITH STACKING MEMBERS

(71) Applicant: AR Packaging Systems AB, Lund (SE)

(72) Inventors: Henrik Herlin, Kristianstad (SE); Eva Sunning, Annelöv (SE); Simon Holka, Staffanstorp (SE)

(73) Assignee: AR Packaging Systems AB

( * ) Notice: Subject to any disclaimer, the term of this patent is extended or adjusted under 35 U.S.C. 154(b) by 32 days.

(21) Appl. No.: 16/302,837

(22) PCT Filed: May 23, 2017

(86) PCT No.: PCT/SE2017/050547
§ 371 (c)(1),
(2) Date: Nov. 19, 2018

(87) PCT Pub. No.: WO2017/204731
PCT Pub. Date: Nov. 30, 2017

(65) Prior Publication Data

US 2019/0300236 A1 Oct. 3, 2019

(30) Foreign Application Priority Data

May 23, 2016 (SE) ..... 1650707-1

(51) Int. Cl.
*B65D 21/032* (2006.01)
*B65D 21/02* (2006.01)
(Continued)

(52) U.S. Cl.
CPC ..... *B65D 21/0222* (2013.01); *B65D 3/14* (2013.01); *B65D 51/20* (2013.01); *B65D 2251/0021* (2013.01); *B65D 2251/0093* (2013.01)

(58) Field of Classification Search
CPC ..... B65D 2543/00027; B65D 21/0222; B65D 3/14; B65D 51/20; B65D 2251/0021;
(Continued)

(56) References Cited

U.S. PATENT DOCUMENTS 3,589,552 A 6/1971 Fitzgerald et al.
3,724,710 A 4/1973 Davis
(Continued)

FOREIGN PATENT DOCUMENTS

CN 1411416 A 4/2003
CN 1829637 A 9/2006
(Continued)

OTHER PUBLICATIONS

Chinese Search Report for Application No. 201780032090.4, dated Sep. 2, 2019, pp. 1-5.
(Continued)

*Primary Examiner* — Stephen J Castellano
(74) *Attorney, Agent, or Firm* — Lerner, David, Littenberg, Krumholz & Mentlik, LLP

(57) ABSTRACT

A lid component for a paperboard packaging container, the lid component comprising a lid part and a connecting part, the lid part comprising a top portion and a side wall portion, the top portion having an outer lid surface, an inner lid surface opposite to the outer lid surface, and a peripheral edge surrounding the outer lid surface; and the connecting part comprising an upper portion and a lower portion and having a lower edge surface. Stacking members are arranged on the outer lid surface and comprise a lid component stacking step and a container stacking step, the lid component stacking step being arranged laterally outboard and below the container stacking step. The lower portion of the connecting part is adapted to be supported by the lid component stacking step. A lid component comprising a
(Continued)

locking arrangement and paperboard packaging container comprising a lid component are also disclosed.

14 Claims, 5 Drawing Sheets

(51) Int. Cl.
*B65D 3/14* (2006.01)
*B65D 51/20* (2006.01)

(58) Field of Classification Search
CPC ..... B65D 2251/0093; B65D 21/0223; B65D 21/0217; B65D 21/022; B65D 43/16; B65D 2543/00435
USPC ..... 220/254.3, 254.9
See application file for complete search history.

(56) References Cited

U.S. PATENT DOCUMENTS

| | | | | |
|---|---|---|---|---|
| 4,154,360 | A | 5/1979 | Smith | |
| 4,364,476 | A * | 12/1982 | Weller | B65D 43/0212 206/508 |
| 5,046,632 | A | 9/1991 | Bordner | |
| 5,810,188 | A | 9/1998 | Novakoski et al. | |
| 6,685,049 | B1 * | 2/2004 | Paladino | B65D 25/205 206/515 |
| 2003/0155360 | A1 | 8/2003 | Gotz et al. | |
| 2007/0108210 | A1 | 5/2007 | Alvares et al. | |
| 2008/0099481 | A1 | 5/2008 | D' Amato | |
| 2011/0121009 | A1 | 5/2011 | Alvares et al. | |
| 2012/0061413 | A1 | 3/2012 | Dols et al. | |
| 2015/0129532 | A1 * | 5/2015 | Alvares | B65D 21/0222 215/228 |
| 2015/0210444 | A1 | 7/2015 | Mercado et al. | |
| 2015/0210450 | A1 | 7/2015 | Mercado et al. | |
| 2016/0000270 | A1 | 1/2016 | Wiggins et al. | |
| 2018/0020876 | A1 | 1/2018 | Herlin et al. | |

FOREIGN PATENT DOCUMENTS

| | | | |
|---|---|---|---|
| CN | 101005995 | A | 7/2007 |
| CN | 101821171 | A | 9/2010 |
| CN | 107406172 | A | 11/2017 |
| EP | 1864914 | A1 | 12/2007 |
| WO | 2007142522 | A2 | 12/2007 |
| WO | 2014129887 | A1 | 8/2014 |
| WO | 2016072912 | A1 | 5/2016 |
| WO | 2016126190 | A1 | 8/2016 |

OTHER PUBLICATIONS

International Search Report from PCT/SE2017/050547, dated Sep. 29, 2017, pp. 1-8.
Office Action and Search Report for Swedish Patent Application No. 1650707-1 dated Dec. 22, 2016, pp. 1-12.
Office Action and Search Report for Swedish Patent Application No. 1650707-1 dated Sep. 29, 2017, pp. 1-7.

* cited by examiner

PACKAGING CONTAINER WITH STACKING MEMBERS

CROSS-REFERENCE TO RELATED APPLICATIONS

This application is a national phase entry under 35 U.S.C. § 371 of International Application No. PCT/SE2017/050547 filed on May 23, 2017, which claims priority to Swedish Patent Application No. 1650707-1 filed on May 23, 2016, the disclosures of which are incorporated herein by reference.

TECHNICAL FIELD

The invention pertains to a lid component for a paperboard packaging container comprising a lid part and a connecting part. The lid part has an outer lid surface with a peripheral edge surrounding the outer lid surface and an inner surface opposite to the outer lid surface and with stacking members being arranged on the outer lid surface and on the lower portion. The invention also pertains to a packaging container for bulk solids, such as granulated or pulverulent foodstuffs and comprising a lid component with stacking members.

BACKGROUND OF THE INVENTION

In the area of packaging of consumer goods, and in particular when packaging dry flowable pulverulent consumer goods it is common to use disposable rigid paperboard packaging containers which serve as protective transport and storage containers at the retail end and as storage and dispensing containers at the consumer end. Such paperboard containers are usually provided with an openable and closable lid, and may additionally be sealed with an inner removable or breakable barrier membrane which keeps the contents fresh and protected against contamination up until a first opening of the packaging container by a consumer.

The packaging containers are generally provided with means for allowing two or more packaging containers to be arranged in a stacked configuration during transporting and storage of the packaging containers. Mating stacking means may be arranged at the container bottom end and at the container opening end. The stacking means at the container opening end may be arranged on a container lid, as disclosed in WO2007/142522 A1.

Lids for paperboard packaging containers may also be provided with mating stacking members arranged on the upper outer surface and on the inner lower surface of each lid, making the lids separately stackable before being applied to a packaging container, e.g. in a process for producing paperboard packaging containers. In a similar fashion container lid components comprising a lid part hingedly connected to a connecting part may be provided with mating stacking members making the lid components separately stackable.

WO2007/142522 A1 discloses a container assembly comprising a lid part having a connection portion for connection to a container part and a lid pivotably connected to the connection portion. Stacking means comprising a cam are arranged on the container lid and are complementary to stacking means arranged on the connecting portion as well as being complementary to stacking means arranged at the bottom of the container part.

U.S. Pat. No. 5,046,632 A discloses a container having a resilient molded lid which is snap-fastened on the container.

The lid initially includes a lower skirt assembly and can be applied on the container in two different positions, wherein a first position is a temporary transport position and a second position is a packaging position wherein the lid cannot be removed from the packaging container without first tearing off the lower skirt assembly. The lid has a container stacking surface which serves for stacking containers on top of each other and a lid centering ridge or lid seating surface which serves to stack lids before they are applied to a container.

An object of the present disclosure is to offer paperboard packaging containers as well as individual lids or lid components of paperboard packaging containers having improved stackability. A further object of the present disclosure may be to offer stackable paperboard packaging containers and stackable lids or lid components having highly functional, space saving stacking features. Yet an object may be to provide inconspicuous stacking features allowing efficient stacking both of paperboard packaging containers and individual lids and lid components of paperboard packaging containers.

SUMMARY OF THE INVENTION

One or more of the above objects may be achieved with a lid component for a paperboard packaging container for bulk solids, in accordance with claim 1 or a paperboard packaging container for bulk solids in accordance with claim 14. Further embodiments are set out in the dependent claims, in the following description and in the drawings.

The lid component for a paperboard packaging container as disclosed herein has a lateral direction and a height direction perpendicular to the lateral direction and comprises a lid part and a connecting part, the lid part comprising a top portion and a side wall portion. The top portion has an outer lid surface and an inner lid surface opposite to the outer lid surface and a peripheral edge surrounding the outer lid surface. The connecting part comprises an upper portion and a lower portion in said height direction and has a lower edge surface. Stacking members are arranged on the outer lid surface, the stacking members on the outer lid surface comprise a lid component stacking step and a container stacking step. The container stacking step comprises a first support surface arranged at a first level below an uppermost level of the outer lid surface in the height direction of the lid component and the lid component stacking step comprises a first support surface arranged at a second level below the uppermost level of the outer lid surface and below the first level in the height direction of the lid component. The lid component stacking step is arranged at the peripheral edge of the outer lid surface, outboard of the container stacking step in the lateral direction of the lid component, and the connecting part is adapted to fit on and be supported by the lid component stacking step. The container stacking step is adapted for receiving and supporting a bottom edge of a packaging container. The lid component stacking step and/or the container stacking step comprises one or more interruptions, such as two interruptions, three interruptions or four interruptions.

The lid part and the connecting part of a lid component as disclosed herein may be fully separable parts, partially separable parts or completely inseparable parts. In a lid component having fully separable parts, the parts are separably and reclosably connected to each other in a closed configuration of the lid component. In a lid component having partially separable parts, the parts are connected to each other by a hinge and can be moved between a closed configuration of the lid component and an open configuration of the lid component by pivoting around the hinge. A lid component having inseparable parts is a lid component in which the connecting part forms an integral continuation of the side wall portion of the lid part.

The paperboard packaging containers as disclosed herein are packaging containers for bulk solids and comprise a lid component as disclosed herein. A packaging container as disclosed herein has a container bottom and a container body comprising a container wall which extends from a container bottom edge to a container body opening in a height direction, H, of the container. The packaging container further comprises a closure arrangement comprising a connecting part and a lid which are parts of a lid component as disclosed herein. The lid comprises the lid part of the lid component and the connecting part of the lid component is directly or indirectly attached or attachable to the container body at the container body opening. A bottom reinforcing rim is attached to the container body at the container bottom edge. The bottom reinforcing rim is adapted for stacking cooperation with the container stacking step on the top portion of the lid part.

In the packaging container as disclosed herein, the lower end surface of the bottom reinforcing rim may be adapted for stacking cooperation with the first support surface of the container stacking step and the inner wall of the bottom reinforcing rim may be adapted for stacking cooperation with the second support surface of the container stacking step. When stacking a second container as disclosed herein upon a first container as disclosed herein, the lower end surface of the bottom reinforcing rim of the second container rests on the first support surface of the container stacking step of the first container and the second support surface of the container stacking step restricts lateral movement of the second container in relation to the first container.

Accordingly, a container stacked upon another container as disclosed herein is supported in the height direction by the first support surface of the container stacking step and in the lateral direction by the second support surface of the container stacking step. Thereby, a stack of the containers as disclosed herein has very high stability both in the lateral direction and in the height direction. When the stack is placed on a horizontal surface, the lateral direction coincides with the horizontal direction and the height direction coincides with the vertical direction.

As set out herein the stacking members are arranged on the outer lid surface of the lid component and comprise a lid component stacking step and a container stacking step with the lid component stacking step being arranged laterally outboard and below the container stacking step. By arranging the stacking means at the very edge of the lid parts, the stacking means intrude minimally on the upper surface of the container lid and a large central area of the lid is left available for display purposes, e.g. for conveying information, logos, and/or for design purposes. As the stacking steps of the invention are arranged at levels below the central area of the upper outer surface of the lid part, they are inconspicuous and their function as stacking means may not be immediately apparent to an end user of the packaging container. The packaging container may be perceived as having a more appealing and "designed" appearance and less of a technical character which may be beneficial when the container is placed where it can be seen such as on a counter top in the user's home or on a shelf in a shop.

When stacked together, the lid components as disclosed herein are nested in each other such that they may be stacked in a space saving yet efficient and stable manner with each lid component adding less to the height of the stack than a height of the lid component. Thus, a combined height of the stacked lid components is less than the sum of the individual heights of the lid components. A space saving stacking configuration is advantageous for transport and storage purposes as well as during production of packaging containers. A space saving stacking renders the supply of lid components in a production process more efficient as magazines for lid components may contain a greater number of lid components and require less frequent refilling. When stacking a further lid component on top of another lid component as disclosed herein, the ratio between the height added to the stack by the further lid component to the height of the further lid component may be from 0.5 to 0.8, such as 0.7.

Accordingly, the two-step configuration of the peripheral portion of the lid part of the lid component offers stable and efficient stacking of individual lid components as well as of packaging containers comprising the lid components. The provision of separate stacking steps for the lid components and for the packaging containers on the outer surface of the lid part of the lid component makes it possible to size and configure each stacking step to be optimal for the particular stacking purpose.

The lid component as disclosed herein, as well as the bottom reinforcing rim may be formed from a polymeric material, preferably a thermoplastic polymeric material which can be produced by well-known production methods such as injection molding.

As disclosed herein, the lid part of the lid component is provided with two different and distinct stacking members arranged as two generally L-shaped stacking steps at the peripheral edge of the outer lid surface. The lid component stacking step is located outward of the container stacking step as seen in the lateral direction, L, of the lid component and below the container stacking step as seen in the height direction. When stacking a second lid component on a first lid component, the lid component stacking step of the first lid component receives the lower portion of the connecting part of the second lid component in a mating fashion such that the lower portion of the connecting part fits in a nesting manner on the lid component stacking step.

The first support surface of the lid component stacking step may be arranged to support the lower edge surface of the lower portion, i.e. in the height direction of the lid components.

The lid component stacking step and the container stacking step may each comprise a second support surface.

The second support surface of the lid component stacking step may be arranged to support an inner wall of the lower portion of the connecting part, i.e. to support the second lid component in the lateral direction of the lid components. Accordingly, first and second support surfaces may be arranged to take up forces in two generally perpendicular directions corresponding to the vertical direction and the horizontal direction when the lid components are stacked on each other on a horizontal surface.

The first and second support surfaces of a stacking step as disclosed herein may be arranged perpendicular to each other or nearly perpendicular to each other, i.e. the angle between the first and second support surfaces may be 90°±3°.

Each of the stacking steps may be arranged along 50% or more of the peripheral edge of the outer lid surface, such as along at 60% or more of the peripheral edge of the outer lid surface, or along 80% or more of the peripheral edge of the outer lid surface.

As set out herein one or both of the stacking steps has one or more interruptions, such as two interruptions, three interruptions or four interruptions.

A pair of interruptions may be arranged at opposite locations along the peripheral edge of the outer lid surface, e.g. at opposite side portions of the peripheral edge of the outer lid surface. The interruptions may be arranged only in the top portion of the lid part or may be arranged also in the connecting part of the lid component.

Interruptions in one or both stacking steps may serve as separation means for facilitating gripping and separation of individual lid components from a stack of lid components when applying the lid components to a container body in a production process for producing a packaging container as disclosed herein. The provision of separation means is particularly useful when stacking lid components which fit snugly on each other with very thin split lines between the stacked lid components. Although such close-fitting lid components form compact stacks with a smooth and regular shape, which is beneficial for storage and transport of the stacked lid components as well as for handling of the stacks of lid components in a packaging machine, it has been found that the lid components tend to stick closely together and to be difficult to separate at the high speed required in a production process. In addition to facilitating separation of the closely stacked lid components by inserting gripping members into the interruptions, the interruptions counteract the formation of a sub-atmospheric pressure in the spaces between the stacked lid components as the interruptions act as air channels between the interior of the stack and the exterior of the stack. A lowered air pressure in the interior spaces between the stacked lid components creates a suction force which tends to hold the lid components firmly together. Conversely, a higher pressure in the interior of the stacks than on their outside may tend to decrease the stability of the stacks by forcing the lid components apart.

As set out herein, a lid component having fully or partly separable parts, may assume a closed configuration with the lid part overlapping with the connecting part, and an open configuration with the lid part and the connecting part arranged side-by-side. The height dimension and the lateral dimension of a lid component comprising fully or partly separable lid and connecting parts are the dimensions of the lid component when in the closed configuration.

A height of a lid component as disclosed herein is a total or combined height of the lid part and the connecting part in the height direction of the lid component and may be from 5 millimetres to 50 millimetres, such as from 10 millimetres to 30 millimetres or from 15 millimetres to 25 millimetres.

The height of the second support surface of the lid component stacking step on a lid component as disclosed herein may be from 0.3 millimetres to 7 millimetres as measured in the height direction of the lid component.

The height of the second support surface of the container stacking step on a lid component as disclosed herein may be from 0.3 millimetres to 7 millimetres as measured in the height direction of the lid component.

The first support surface of the lid component stacking step has a width in the lateral direction of the lid component which is sufficient to support the lower edge surface of the lower portion of the connecting part if the lid component. It may be preferred that the width of the first support surface of the lid component stacking step corresponds to the width of the lower edge surface of the lower portion of the connecting part in the lateral direction of the lid component, such that the width of the first support surface of the lid component stacking step differs from the width of the lower edge surface of the lower portion of the connecting part with at most 20%.

The width of the first support surface of the lid component stacking step on a lid component as disclosed herein may be from 0.5 millimetres to 5 millimetres, such as from 1 millimetre to 3 millimetres.

The width of the first support surface of the container stacking step on a lid component as disclosed herein may be from 1 millimetre to 10 millimetres as measured in the lateral direction of the lid component, such as from 2 millimetres to 7 millimetres.

The width of the lid component stacking step may generally be smaller than the width of the container stacking step. As the stacking steps are designated for stacking of lid components and packaging containers respectively, each stacking step may be specifically designed to match the shape and size of the corresponding part of the lid component or of the packaging container. Thereby, stacks of lid components and stacks of packaging containers may be created which are space saving and have very high stability as the stacking steps provide optimal support for the stacked lid components or packaging containers both in the height direction and in the lateral direction of the stacks.

The width of the first support surface of the lid component stacking step may correspond to a width of the lower edge surface of the lower portion of the connection part in the lateral direction of the lid component.

Alternatively, the width of the first support surface of the lid component stacking step may be greater or smaller than the width of the lower edge surface of the lower portion of the connecting part in the lateral direction of the lid component. It may be preferred that the lower edge surface of the lower portion of the connecting part can be completely accommodated on the first support surface.

In a lid component as disclosed herein, the lower portion of the connecting part may be arranged such that the connecting parts become flush with the lid part side walls in a stack of lid components. Accordingly, it may be preferred that the lower portion of the connecting part fits on the lid component stacking step such that a stack of lid components assumes a shape with generally regular outer surfaces without protruding parts or edges which may impair handling of the stack in a packaging machine.

In a packaging container as disclosed herein, the lid may be arranged to be completely removed when opening the container. When the container lid is a completely removable lid, the lid part of the lid component is either completely integrated with the connecting part of the lid component and the lid component is arranged to cooperate with a separate rim attached to the container body for closing and opening of the packaging container or the lid part and the connection part are fully separable, i.e. the lid part is free from permanent connections to the connecting part of the lid component and the lid part is arranged to cooperate with the connecting portion for closing and opening of the packaging container.

Alternatively, the container lid may be of the type which is opened by pivoting the lid about a hinge. In such case, the lid part of the lid component is connected to the connecting part of the lid component by means of a hinge. The hinge may be a live hinge, i.e. a flexible piece of material connecting the lid part with the connecting part. A live hinge may be formed integral with the lid part and/or with the connecting part or may be a separately formed element which is attached to the lid part and to the connecting part. Alternatively, the hinge may be a two-part hinge, with a first hinge part arranged on the lid part and a second hinge part arranged on the connecting part the two hinge parts being connected to each other to form the lid component.

The lid part of the lid component may be a complete lid or may be only a part of a lid, which is assembled with one or more additional lid components to form the container lid.

By way of example, the lid part may be an outer lid part defining the shape and size of the portion of the lid which is exposed to the exterior of the packaging container and which is combined in the container lid with an inner lid part such as an inner disc. The inner disc may be made from carton, plastic, or any suitable material or laminate of materials.

In a packaging container as disclosed herein, the connecting part of the lid component may be a first connecting part of a rim construction, wherein the first connecting part is applied to the packaging container at the container body opening edge and is indirectly attached to the container body by being connected to a second connecting part, such as an upper reinforcing rim which is directly attached to the container body at the container body opening edge e.g. by being glued or welded to the inside and/or to the outside of the container wall. The first connecting part may be mechanically connected to the second connecting part. A mechanical connection between the first connecting part and the second connecting part may be accomplished by mating contours on the first connecting part and on the second connecting part. Such mating contours preferably include snap-fit features such as interengaging ridges and tracks or protrusions and holes/cavities, etc. The mechanical connection between the first connecting part and the second connecting part is preferably irreversible implying that once established the connection can only be broken by destroying or damaging the connected parts.

As used herein, a paperboard packaging container is a packaging container wherein the container body is formed from paperboard sheet material. The paperboard container may be formed in any manner known in the art, e.g. by forming a container body by bending a paperboard sheet material into a tubular shape and longitudinally closing the tube by joining overlapping or abutting side edges of the paperboard material. The join between the side edges may be covered by a sealing strip. In the paperboard packaging containers as disclosed herein, the container bottom is formed from a separate bottom disc which is attached at the bottom end of the container body tube. The bottom disc may be attached on the inside of the container body tube and may be inset from the container body bottom edge to accommodate a bottom reinforcing rim attached to the inner surface of the container body.

As used herein, a paperboard material is a sheet material predominantly made from cellulose fibres or paper fibres. The sheet material may be provided in the form of a continuous web or may be provided as individual sheets of material. The paperboard material may be a single ply or multi ply material and may be a laminate comprising one or more layers of materials such as polymeric films and coatings, metal foil, etc. The polymeric films and coatings may include or consist of thermoplastic polymers. The paperboard material may be coated, printed, embossed, etc. and may comprise fillers, pigments, binders and other additives as known in the art. The paperboard materials as disclosed herein may also be referred to as cardboard or carton materials.

As used herein, the term "bulk solids" refers to a solid bulk material from which a desired amount of the product may be poured, scooped or taken by hand out of a packaging container. The bulk material may be dry or moist. The bulk solids which are suitable for packing in the paperboard packaging containers as disclosed herein include any material in the form of particles, granules, grinds, plant fragments, short fibres, flakes, seeds, pieces, etc.

The paperboard packaging container as disclosed herein may be a container for alimentary products such as infant formula, coffee, tea, rice, flour, sugar, cereals, soup powder, custard powder, pasta, snacks, or the like. Alternatively, the bulk solids may be non-alimentary, such as tobacco, detergent, fertilizer, chemicals or the like.

The packaging container may be provided with an openable or peelable sealing membrane which can be fully or partly removed by a user in order to provide initial access to an interior compartment of the packaging container either by breaking a seal between the sealing membrane and the inner surface of the container wall, or by tearing or otherwise breaking the sealing membrane itself. The openable or peelable sealing membrane may be provided with a gripping tab, a pull ring, or other means for facilitating removal of the sealing membrane.

A peelable or tearable sealing membrane may be gastight or gas-permeable. A gastight membrane may be manufactured from any material or material combination suitable for providing a gastight sealing of a compartment delimited by the sealing membrane, such as aluminium foil, silicon-coated paper, plastic film, or laminates thereof. A gastight membrane is advantageous when the bulk solids stored in the packaging container are sensitive to air and/or moisture and it is desirable to avoid contact of the packaged bulk solids with ambient air.

The barrier properties of the packaging containers disclosed herein may be designed to meet different requirements of tightness depending on the goods which is packaged in the packaging container. By way of example, in a packaging container for dried peas a lower barrier level may be sufficient than in a packaging container for e.g. infant formula which is highly sensitive to oxygen and moisture exposure.

A gastight packaging container is particularly advantageous when the pulverulent material stored in the packaging container is sensitive to air and/or moisture. It may also be desirable to keep fragrances and aromas in the packaging container and prevent the packaged contents from taking up scents and flavours from the ambient air.

The paperboard packaging container as disclosed herein may comprise an inner peelable or openable sealing membrane forming a cross-sectional seal between an inner compartment in the container body and the container opening. The inner peelable or openable sealing membrane is a transport and storage seal which is eventually partly or fully removed by an end user of the packaging container.

The peelable or openable sealing membrane is fully or partly removed by breaking a seal between the sealing membrane and the inner surface of the container wall, or by tearing or otherwise breaking the sealing membrane itself. Tearable sealing membranes may be provided with one or more predefined weakenings, such as perforations or a cut partly through the membrane.

A peelable or tearable sealing membrane may be gastight or gas-permeable. A gastight membrane may be manufactured from any material or material combination suitable for providing gastight sealing of a compartment delimited by the sealing membrane, such as aluminium foil, silicon-coated paper, plastic film, paperboard, or laminates thereof.

The closure arrangement on the paperboard packaging container as disclosed herein may comprise a locking arrangement which is configured to maintain the lid in a closed position at the container access opening. Any locking arrangement as known in the art may be used, such as the locking arrangements disclosed in PCTSE2015/051151.

The locking arrangement may comprise a first locking element arranged on the connecting part of the lid component or on the container body and a second locking element arranged on the container lid. The first and second locking elements may be mating locking elements, such as female/male locking elements including hooks and other protrusions which are arranged to interengage with ridges, hooks, tracks, holes, cavities, loops, etc. By way of example, a locking arrangement may be provided by a locking flap or clasp closure extending from a permanent anchoring site at an edge on the lid part, such as from a forward edge on the lid part and comprising at least one locking element which can be fastened into or onto a corresponding locking element on the container body or on the connecting part of the lid component. Alternatively, the locking flap or clasp closure may be arranged to extend from a permanent anchoring site on the container body or on the connecting part of the lid component and be arranged to be releasably fastened to the lid part. Accordingly, the locking arrangement may comprise at least one locking flap being permanently joined to the connecting part of the lid component, such as at a front edge portion and/or at a side edge portion of the container opening. The locking flap has a free end portion extending past the edge of the container opening in the height direction of the packaging container. The free end portion of the locking flap comprises a first locking element which is arranged to mate with a second locking element on the outer surface of the lid part. Preferably, the first and second locking elements are arranged to mate on the outer lid surface of the top portion of the of the lid part. When the locking flap is in the closed position with the first and second locking elements engaging with each other, the lid part and the connecting part are firmly clamped together and kept under tension. The locking flap is preferably hingedly connected to the connecting part, preferably by means of a live hinge formed integrally with the connecting part and the locking flap.

The stacking steps may extend over the locking flap, whereby the locking flap in the closed position forms a continuation of the side wall portion of the lid part. At the same time, the parts of the stacking steps which are arranged on the locking flap may contribute to improve grippability of the locking flap and facilitate manipulation of the locking flap between the open and closed positions.

An inset gripping area may be arranged in the outer lid surface of the top portion of the lid part. The inset gripping area is arranged at the free end portion of the locking flap and serves to provide access to the free end portion of the locking flap in a direction perpendicular to the height direction of the lid component. Thereby, the locking flap can be easily manipulated even if no part of the locking flap in the closed position extends in the height direction of the lid component beyond the outer lid surface of the top portion of the of the lid part.

The locking elements are preferably designed to allow repeated opening and closing of the locking arrangement. Manipulation of the locking arrangement may be facilitated by means of gripping devices such as finger grips, friction enhancing elements, pull tabs, etc.

The container body of the packaging container as disclosed herein may have four main body wall portions; a front wall portion arranged opposite a rear wall portion and two opposing side wall portions extending between the front wall portion and the rear wall portion. The body wall portions are connected at corners or corner portions which may be formed between planar surfaces arranged at right angles to each other or may be curved or bevelled corner portions providing the packaging container with a softer, slightly rounded appearance. Moreover, the shape of the body wall portions may deviate from a planar shape, with one or more of the body wall portions having an outward or inward curvature. When the container body has one or more outwardly curved body wall portion the curvature of any such body wall portion is always lesser than the curvature of any curved corner portion, i.e. a radius of curvature of a corner portion in the container body of the packaging container as disclosed herein is always smaller than any radius of curvature of a body wall portion. A transition between a corner portion and a body wall portion may be seen as a distinct change in curvature or may be seen as a continuous change in curvature. The lid component as disclosed herein has a shape adapted to the shape of the container body. In a packaging container having distinguishable front, rear and side portions, a hinge connecting the lid to the connecting portion may be placed at the rear portion, a locking arrangement may be placed at the front portion. The separation means for separating individual lid components from a stack of lid components may be arranged at the side portions of the lid components which correspond to the side portions of the packaging container.

In paperboard containers, there is a conflict between minimizing the amount of paperboard material used in the containers and making the containers sufficiently rigid to avoid that the containers are damaged or that they collapse, e.g. when stacked during transport and storage. It has been found that by making one or more container walls outwardly curved or only slightly outwardly curved, shape stability and rigidity of the packaging container may be considerably improved as compared to conventional packaging containers having planar walls. Consequently, paperboard packaging containers having adequate rigidity and crush-resistance may be made using thinner paperboard sheets than in a paperboard packaging container having planar side walls.

The radii of curvature of the container walls may be selected such that the container walls are provided with a near-planar shape, implying that the container walls are perceived by a consumer as being planar. Such packaging containers are disclosed in PCT/SE2016/050075.

The container body can be made without any distinct body wall portions and may have any suitable foot-print shape, such as circular, oval, elliptic, triangular, pentagonal, hexagonal, etc.

A rigid plastic upper reinforcing rim or connecting part which is directly connected to the upper edge of the container body wall contributes to shape and stabilize the flexible paperboard container body opening edge and thereby ascertains that the container body wall is provided with a desired shape and in particular that the container body wall can be imparted with a predetermined and stable curvature. In a corresponding manner, the bottom rim further contributes to shape and stabilize the container body bottom edge and the container body wall.

BRIEF DESCRIPTION OF THE DRAWINGS

The present invention will be further explained hereinafter by means of non-limiting examples and with reference to the appended drawings wherein.

DETAILED DESCRIPTION

It is to be understood that the drawings are schematic and that individual components, such as layers of material are not necessarily drawn to scale. The packaging container and lid component shown in the figures are provided as examples only and should not be considered limiting to the invention as disclosed herein. It should be understood that the stacking means as disclosed herein are applicable in a corresponding manner to lid components in which the lid part and the connecting part are formed in on piece with the connecting part being an integral continuation of the side wall portion of the lid part.

Figure 1:
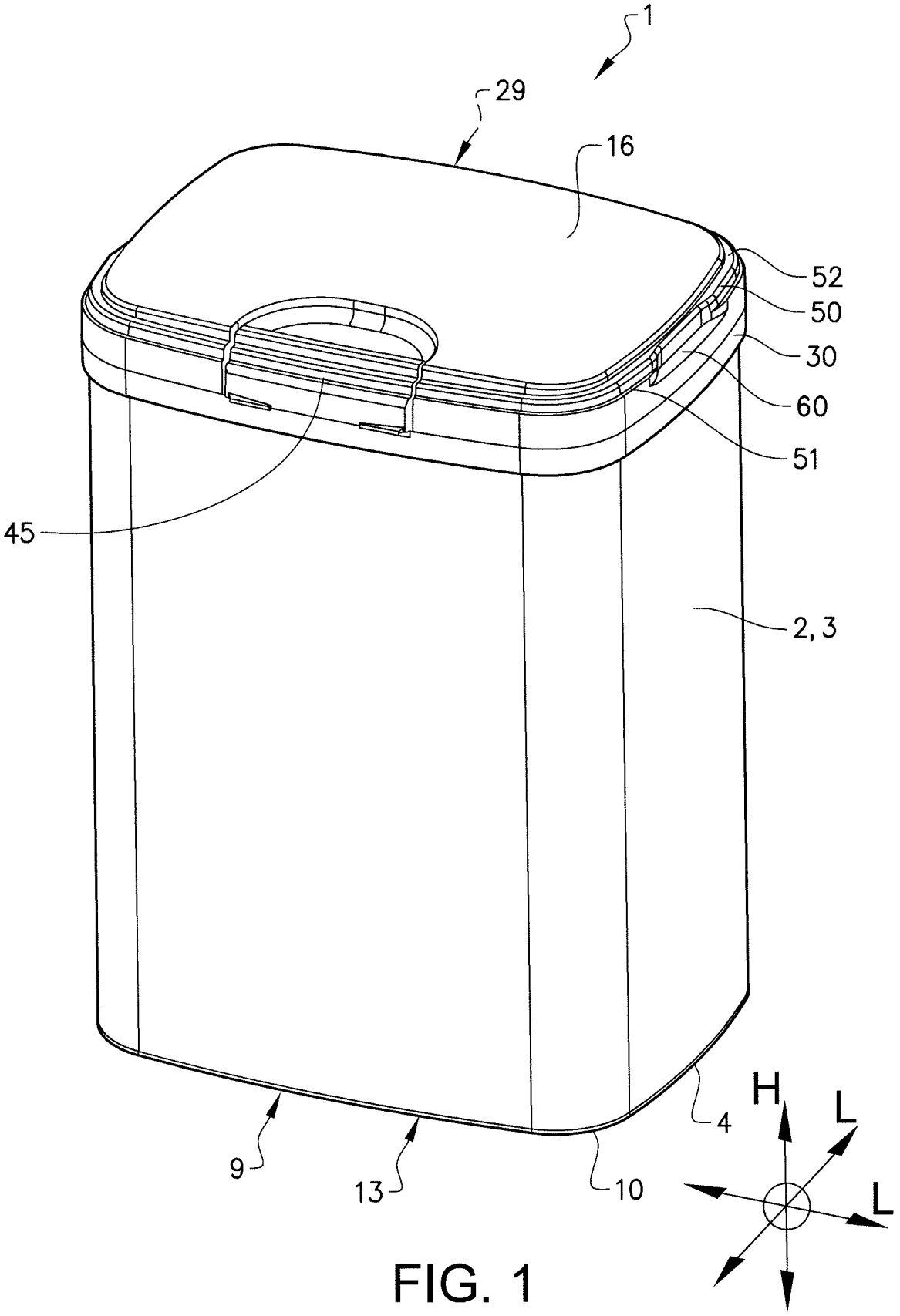
FIG. 1 shows a stackable packaging container.
Figure 2:
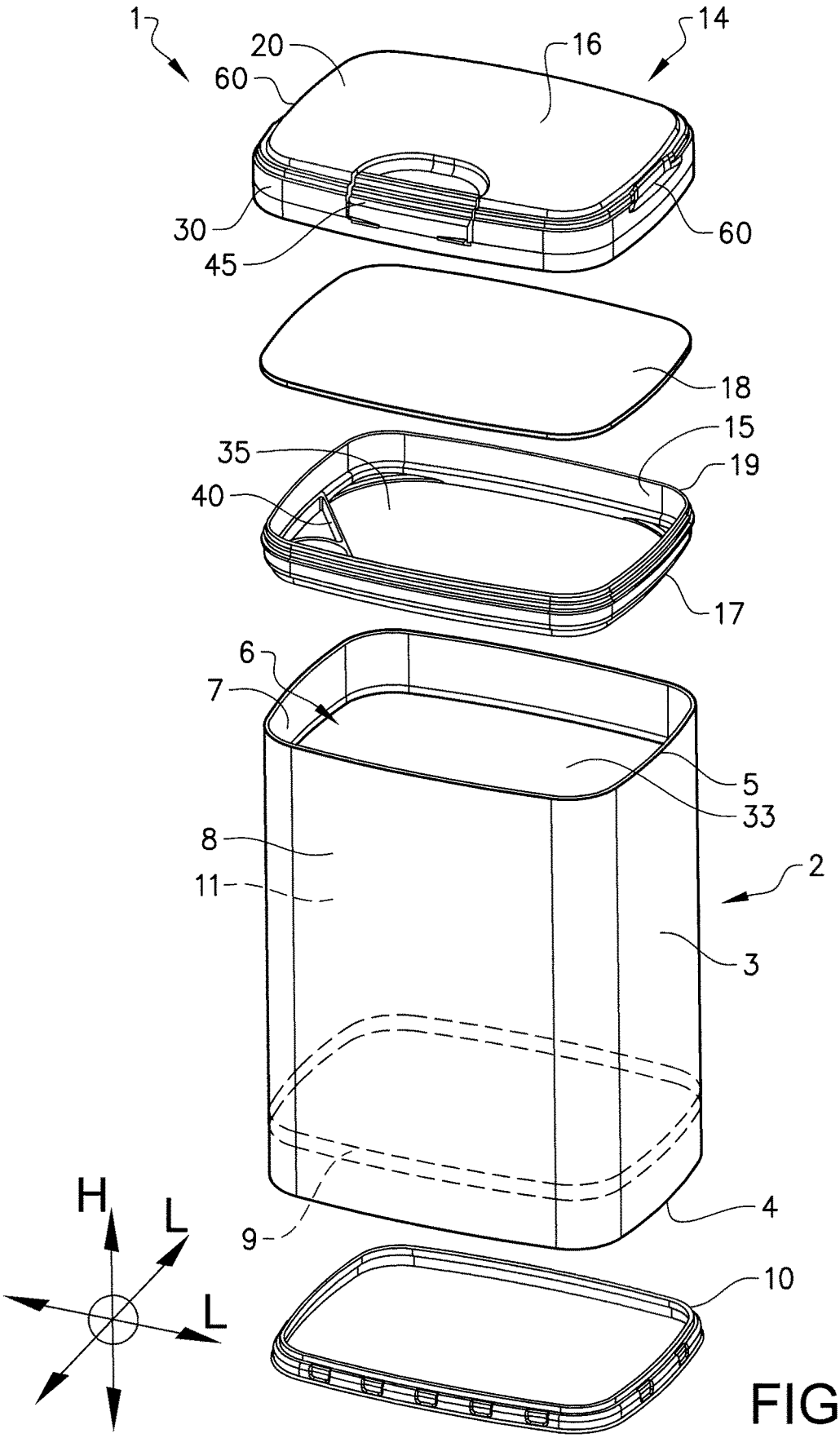
FIG. 2 shows an exploded view of the packaging container in FIG. 1.

With reference to FIGS. 1 and 2 there is shown a paperboard packaging container 1 for bulk solids. The particular shape of the container 1 shown in the figures should not be considered limiting to the invention. Accordingly, the paperboard packaging container according to the invention may have any useful shape or size.

The packaging container 1 comprises a container body 2 formed by a tubular container wall 3. The container wall 3 extends from a container body bottom edge 4 to a container body opening edge 5 at a container body opening 6 in a height direction H of the packaging container 1, perpendicular to a lateral direction L of the packaging container 1. The container wall 3 has an inner surface 7 facing towards an inner compartment 11 in the packaging container 1 and an outer surface 8 facing away from the inner compartment 11 and being exposed to the exterior of the packaging container 1. A bottom disc 9 is positioned at the bottom edge 4 of the container body 2. The container body 2 is made from paperboard material as defined herein. The container body 2 may be formed by bringing together the side edges of a web of paperboard causing the material to assume a tubular shape, where after the side edges are sealed together. Sealing of the side edges may be made by any suitable method as known in the art, such as by welding or gluing, with welding being preferred. Sealing of the side edges of the container body web may involve using a sealing strip, as known in the art. The bottom disc 9 may be made from paperboard, metal, plastic, or from any suitable combination of such materials as known in the art. The body tube may be formed into any desired tubular shape including circular, oval, rectangular and modified rectangular shapes, such as the modified rectangular shape with rounded corners which is shown in the figures.

Figure 3:
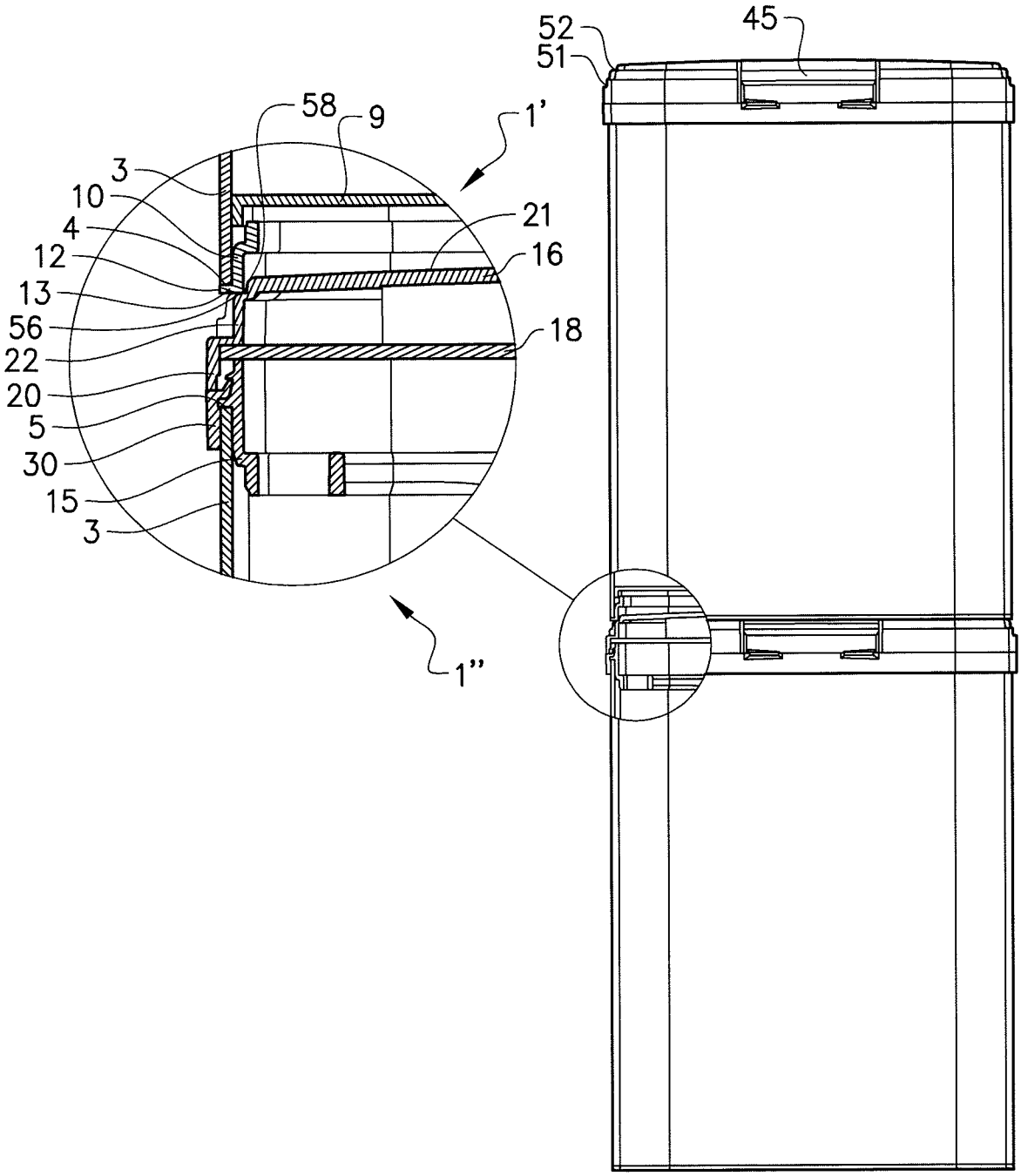
FIG. 3 shows a stack and a detail view illustrating stacking of the packaging container in FIG. 1.

The container body bottom edge 4 is reinforced by a bottom rim 10 which is attached to the inner surface 7 of the container wall 3, between the bottom disc 9 and the container body bottom edge 4 and which has an outwardly directed flange 12 which covers the container body bottom edge 4 and a lower end surface 13 as is shown in FIG. 3. The bottom rim 10 reinforces the container body paperboard bottom edge 4, stabilizes the shape of the container body 2 and protects the container body bottom edge 4 from mechanical deformation. In the embodiment shown in FIG. 3, the flange 12 of the plastic bottom rim 10 also serves as a protective barrier against water and other fluids which may be present on a surface on which the packaging container is placed. The bottom rim 10 delimits a downwardly open space between the bottom disc 9 and the lower end surface 13 of the bottom rim 10 which space may be used to accommodate a part of another packaging container in a stacking configuration, as shown in FIG. 3. The bottom rim may alternatively be attached to the outside of the container body and may be made without the protective flange 12.

The paperboard packaging container 1 is provided with a closure arrangement comprising a lid 16 and an upper reinforcing rim 15 extending along the container body opening edge 5 and defining a perimeter of a container access opening 35 which is smaller than the container body opening 6 which is defined by the upper edge 5 of the container body 2.

The upper reinforcing rim 15 is preferably a plastic rim, most preferably a thermoplastic rim and is attached to the inner surface 7 of the container body wall 3 at the container body opening 6. The upper reinforcing rim 15 has an extension in the height direction, H, of the container 1 and has a lower rim edge 17 facing towards the container bottom 9 and an upper rim edge 19 facing away from the container bottom 9.

The upper reinforcing rim 15 is joined to the inner surface 7 of the container wall 3 e.g. by means of a weld seal extending around the container opening 6. The weld seal preferably extends continuously around the container body opening 5 to provide a seal between the upper reinforcing rim 15 and the container wall 3. The seal is preferably sift-proof, more preferably moisture proof and most preferably gas-tight.

Figure 5:
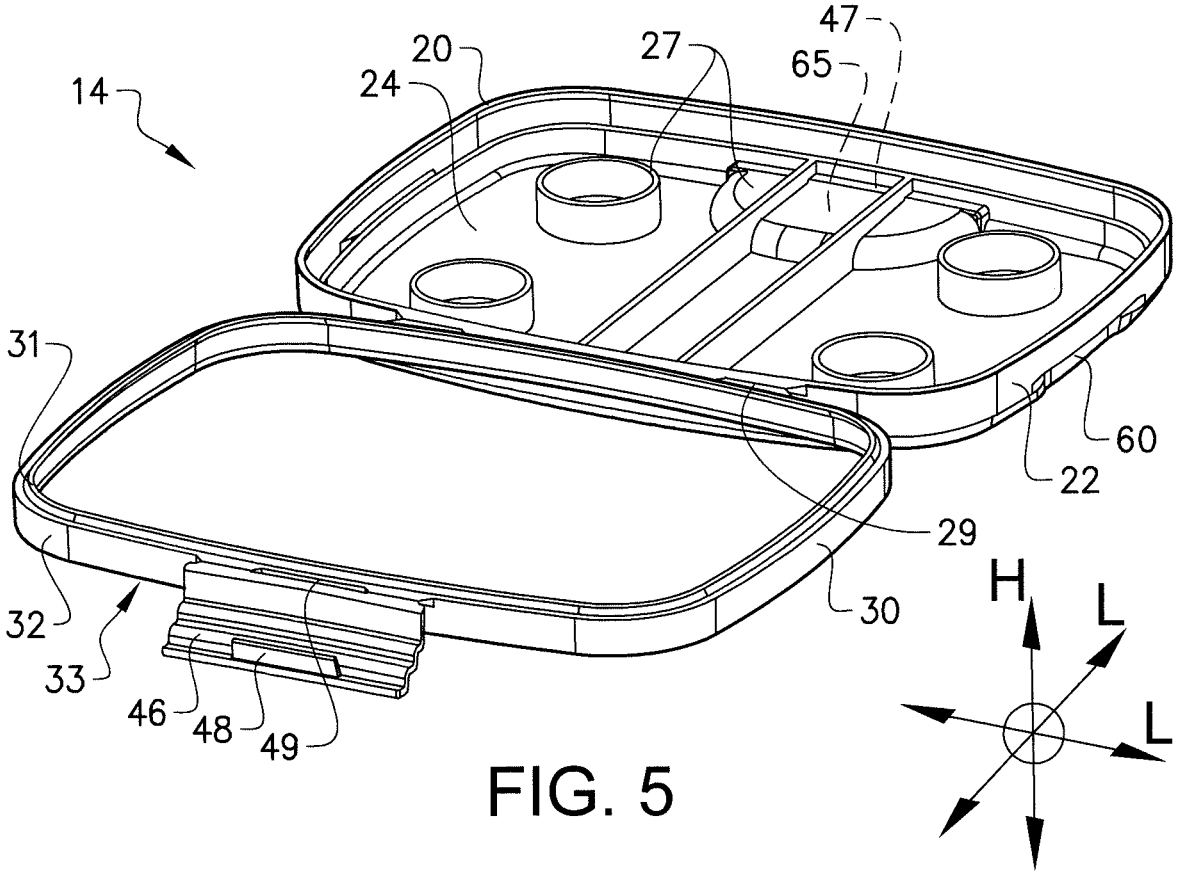
FIG. 5 shows the lid component in FIG. 3 in an open configuration.

The lid 16 comprises an outer lid part 20 which is part of a lid component 14 and an inner lid part 18. The outer lid part 20 is a profiled part with a three-dimensional shape providing an upper outer surface 23 of the lid 16. As is shown in FIG. 5, the outer lid part 20 has an inner surface 24 comprising a pattern of reinforcing elements 27. The inner lid part 18 is a planar disc, as shown in FIG. 2. The inner lid part 18 is attached e.g. by mechanical means or adhesively over the inner surface 24 of the outer lid part 20 and has an inner surface which faces towards the bottom disc 9 when the lid 16 is closed and which is arranged to seal against the upper rim edge 19 of the upper reinforcing rim 15 and an outer surface facing towards the inner surface 24 of the outer lid part 20.

The outer lid part 20 is connected by a hinge 29 to a connecting part 30. The hinge 29 may comprise or consist of a live hinge, formed integrally with the upper lid part 20 and the connecting part 30 as one or more flexible connections between the upper lid part 20 and the connecting part 30. As set out herein a live hinge is only one example of a useful hinge and it should be understood that any other type of functional hinge may be used for creating a hinged connection between the connecting part and the lid. Moreover, the lid may be of the removable kind, without any permanent connection to the connecting part 30.

The connecting part 30 is applied to the packaging container 1 at the container body opening edge 5 and is mechanically attached to the upper reinforcing rim 15 by a snap-on connection. The connecting part 30 is attached to the upper reinforcing rim 15 after the reinforcing rim 15 has been attached to the inner surface 7 of the paperboard container wall 3. Accordingly, the connecting part can be attached at a late stage in a process for assembling and filling the packaging container as disclosed herein. The connecting part 30 is applied to the upper reinforcing rim 15 by pressing the connecting part 30 down over the upper edge 19 of the upper reinforcing rim 15 until the connecting part 30 locks in place on the upper reinforcing rim 15. When the connecting part 30 has been attached to the upper reinforcing rim 15, it can only be removed again by breaking or damaging the connection.

The interior compartment 11 of the packaging container is sealed with a fully or partly removable sealing membrane 33 which constitutes a transport seal over packaged bulk solids in the packaging container 1 and which is sealed to the container body wall 3. The removable sealing membrane 33 may be attached to the container body wall 3 either from the top end of the container body 2 or from the bottom end of the container body 2. In order to gain a first access to the packaged bulk solids, a user opens the lid 16 and exposes the packaged bulk solids by fully or partly removing the sealing membrane 33.

The sealing membrane 33 may be arranged to be peeled away from the wall 3 of the container body 2 or may be arranged with means for breaking the membrane 33 so that it can be at least partly torn away. Such means may be in the form of one or more predefined weakenings, such as perforations or a cut partly through the membrane. When the membrane is of the tear-open type, a narrow edge part of the sealing membrane may be left at the inner surface 7 of the container wall 3. The sealing membrane 33 is an optional feature of the disclosed packaging container 1 and may be omitted.

Once the sealing membrane 33 has been removed, it is sufficient to open the lid 16 in order to gain access to the contents in the interior compartment 11 through the access opening 35. The upper reinforcing rim 15 which is shown in FIG. 2 carries a scraper bar 40 which extends across a corner portion of the reinforcing rim 15. The scraper bar 40 may be a combined scraper bar and scoop holder and may in addition to a scraping edge for scraping off excess scooped-up contents from a scoop or spoon be arranged to receiving and hold a fastening element and/or a scoop head of a scoop or spoon. The scraper bar 40 is an optional element of the packaging container 1 as disclosed herein.

When the packaging container 1 has been opened, a desired quantity of the contents may be removed from the interior compartment 11 through the access opening 35 either by hand, by using a scoop or a spoon, or by pouring. If a scoop or spoon is used, it may be a scoop or spoon which is provided together with the packaging container. The scoop or spoon may initially be placed on the sealing membrane 33, if present, may be removably attached to the inner lid part 18 or may be attached to a combined scraper bar and scoop holder 40.

The closure arrangement as shown on the packaging container 1 in FIGS. 1 and 2 with an upper reinforcing rim 15 directly attached to the inner surface 7 of the container wall 3 and a lid component 14 comprising a lid part 20 and a connecting part 30 provides a tight closure between the lid 16 and the container body 2. When the lid 16 is closed on the packaging container 1, the upper rim edge 19 abuts against the inner lid part 18 and creates a seal between the upper reinforcing rim 15 and the lid 16.

In order to keep the lid 16 secured in the closed position between dispensing occasions, the closure arrangement of the packaging container 1 may further comprise a locking arrangement 45, as seen in FIGS. 1, 2, 4 and 5. The locking arrangement 45 may comprise mating locking elements, e.g. a female locking element such as a groove 47 arranged in the outer lid surface 23 of the top portion 21 of the lid part 20 and a male locking element such as a rib 48 arranged on a locking flap 46 arranged on the connecting part 30. The locking flap 46 is hingedly connected to the connecting part 30, preferably by means of a live hinge 49 formed integrally with the connecting part 30 and the locking flap 46.

Figure 4:
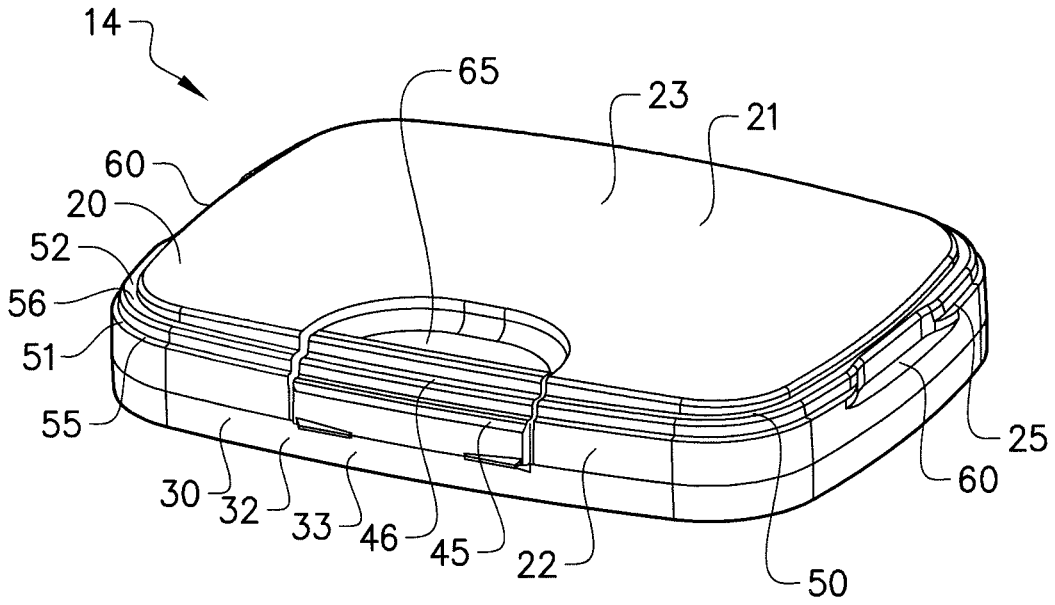
FIG. 4 shows a lid component in a closed configuration.

A locking arrangement 45 of this type is illustrated in the figures and is closed by moving the locking flap 46 upward and inward over the lid 16 to the position shown in FIG. 4 where the locking elements come into mating engagement and is opened by moving the locking flap 46 outward and downward to the position shown in FIG. 5, whereby the locking elements are brought out of engagement with each other. When the locking flap 46 is in the closed position with the first and second locking elements engaging with each other, the lid part 20 and the connecting part 30 are firmly clamped together.

As shown in the figures, the lid component stacking step 51 and the container stacking step 52 may extend across the locking flap 46. Thereby, the locking flap in the closed position which is shown in FIGS. 1, 2, 3 and 4 forms a continuation of the side wall portion 22 of the lid part 20. At the same time, the parts of the stacking steps 51, 52 which are arranged on the locking flap 46 may contribute to improve grippability of the locking flap 46 and facilitate manipulation of the locking flap between the open and the closed positions.

An inset gripping area 65 may be arranged in the outer lid surface 23 of the top portion 21 of the lid part 20. The inset gripping area 65 is arranged at the free end portion of the locking flap which is positioned opposite the hinge 49 and serves to provide access to the free end portion of the locking flap 46 in a direction perpendicular to the height direction H of the lid component 14. Thereby, the locking flap 46 can be easily accessed and manipulated even if no part of the locking flap 46 in the closed position extends in the height direction H of the lid component 14 beyond the outer lid surface 23 of the top portion 21 of the of the lid part 20, as is shown in the figures.

A male locking element may be one or more protrusions, such as one or more knobs or ribs arranged on and the female locking element may be one or more corresponding cavities or grooves. The locking arrangement 45 is preferably designed such that it exerts a force on the connection between the lid 16 and the upper rim edge 19 by pressing the upper edge 19 of the upper reinforcing rim 15 against the inner lid part 18.

The lid component 14 is shown in FIGS. 4 and 5 and comprises a lid part 20 which constitutes the outer lid part 20 of the lid 16 when the lid component 14 is a part of a packaging container such as the packaging container shown in FIGS. 1 and 2, and a connecting part 30 which in the illustrated example is the connecting part 30 of the closure arrangement on the packaging container in FIGS. 1 and 2. The lid component has a lateral direction L and a height direction H perpendicular to the lateral direction L. When the lid component 14 is part of a packaging container, such as the packaging container in FIGS. 1 and 2, the lateral direction L and the height direction H of the lid component coincide with the lateral direction L and the height direction H of the packaging container.

The lid part 20 of the lid component 14 comprises a top portion 21 and a side wall portion 22. The top portion 21 has an outer lid surface 23 and an inner lid surface 24 opposite to the outer lid surface 23 and a peripheral edge 25 surrounding the outer lid surface. The connecting part 30 comprises an upper portion 31 which faces the inner lid surface 24 in the closed configuration of the lid component 14 which is shown in FIG. 4. The connecting part 30 further comprises a lower portion 32 having a lower edge surface 33 which faces away from the inner lid surface 24 in the closed configuration of the lid component 15.

Stacking members 50 are arranged on the outer lid surface 23. The stacking members on the outer lid surface 23 comprise a lid component stacking step 51 and a container stacking step 52. The container stacking step 52 comprises a first support surface 56 arranged at a first level below an uppermost level of the outer lid surface 23 in the height direction H of the lid component 14. The lid component stacking step 51 comprises a first support surface 55 arranged at a second level below the uppermost level of the outer lid surface 23 and below the first level in the height direction H of the lid component 14. The lid component stacking step 51 is arranged at the peripheral edge 25 of the outer lid surface 23, outboard of the container stacking step 52 in the lateral direction L of the lid component 14 whereby the outer lid surface 23 has a stepped configuration in the area immediately inward of the peripheral edge 25. The lower portion 32 of the connecting part 30 is sized and configured to be supported by the lid component stacking step 51.

A paperboard packaging container 1' such as the packaging container 1 shown in FIGS. 1 and 2 may be stacked on another such packaging container 1" by resting the bottom rim 10 on the container stacking step 52 at the peripheral edge 25 of the top portion 21 of the lid part 20, the bottom rim 10 and the container stacking step 52 thus forming mating stacking members. As can be seen in FIG. 3, the top portion 21 of the lid 16 laterally inside of the container stacking step 52 forms a protrusion from the plane in which the container stacking step 52 is arranged. When one packaging container 1 is stacked upon another packaging container as disclosed herein, the protruding portion of the lid 16 is accommodated in the space defined by the bottom disc 9 and the bottom rim 10 at the bottom 9 of an upper stacked packaging container 1'.

As set out herein the lid components 14 are stackable on each other and the packaging containers 1 are also stackable on each other using different stacking means provided on the outer surface of the lid component for stacking the lid components and for stacking the packaging containers.

Figure 6:
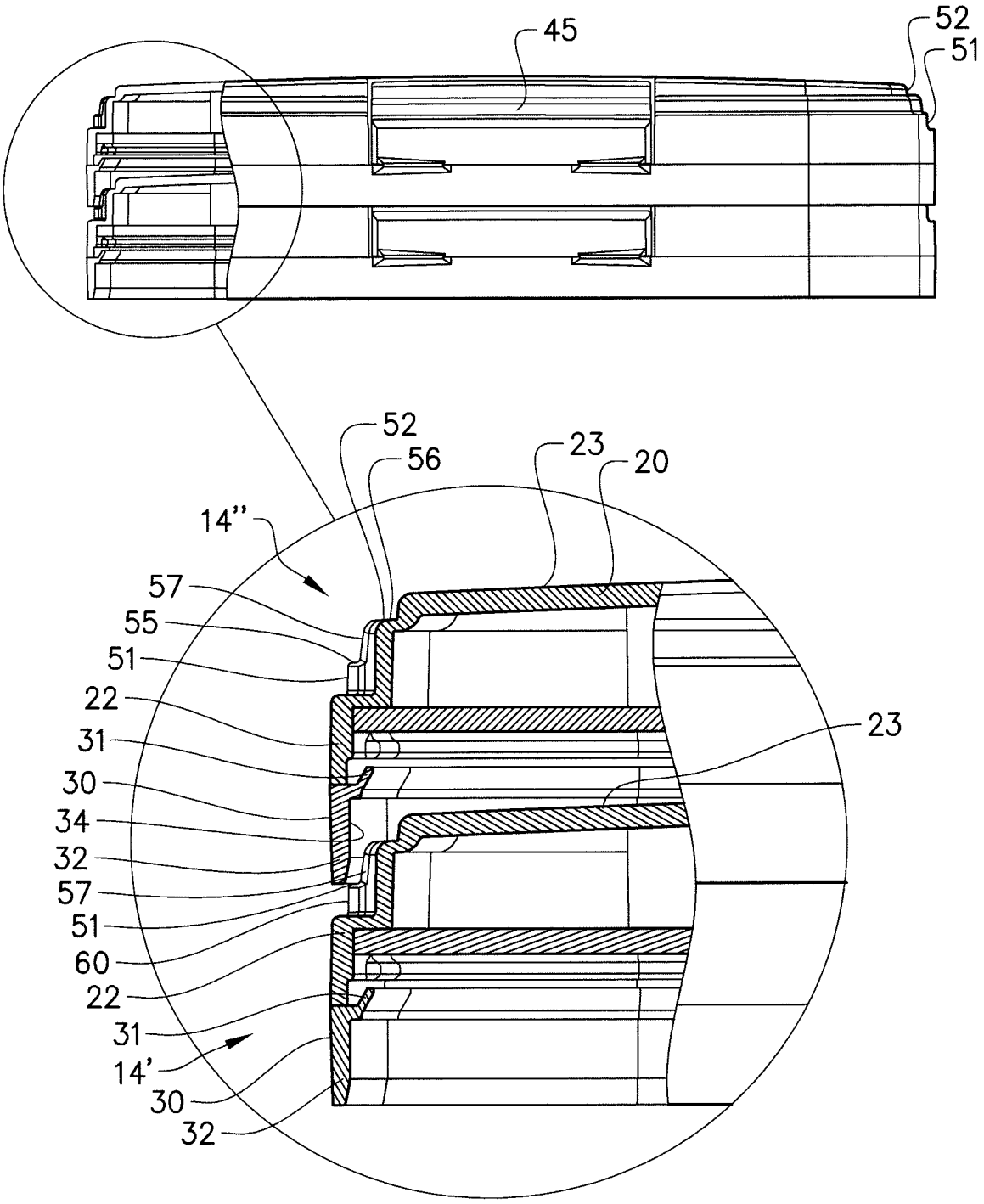
FIG. 6 shows a stack and a detail view illustrating stacking of the lid component in FIG. 5.

When stacking a lid component 14" on another lid component 14', the first support surface 55 of the lid component stacking step 51 of the lower lid component 14' supports the lower edge surface 33 of the lower portion 32 of the connecting part 30 of the second lid component 14", i.e. in the height direction of the lid components 14', 14" as is shown in FIG. 6.

Each of the lid component stacking step 51 and the container stacking step 52 comprises a second support surface 57, 58. The second support surface 58 of the container stacking step 52 is shown in FIG. 3 and the second support surface 57 of the lid component stacking step 51 is shown in FIG. 6.

The second support surface 57 of the lid component stacking step 51 is arranged to support an inner wall 34 of the lower portion 32 of the connecting part 30, i.e. to support the second lid component 14" in the lateral direction L of the lid components 14', 14". Accordingly, the first and second support surfaces 55, 57 of the lid component stacking step 51 are arranged to take up forces in two generally perpendicular directions corresponding to the vertical direction and the horizontal direction when the lid components 14', 14" are stacked on each other on a horizontal surface.

As shown in FIG. 6, the lid components are nested in each other such that the combined height of the stacked lid components 14', 14" is less than the sum of the heights of each individual lid component 14', 14".

As set out herein, the first and second support surfaces of a stacking step may be arranged perpendicular to each other or nearly perpendicular to each other, i.e. the angle between the first and second support surfaces may be 90°±3°. One or both of the second support surfaces of the stacking steps as disclosed herein may have a curved or slanted upper part which may serve as a guiding means when stacking one lid component on another lid component or when stacking a packaging container on another packaging container. Stacking steps in which the second support surfaces 57, 58 have a curved upper part are shown in the figures.

As is shown in the figures, a pair of interruptions 60 in the stacking steps is arranged at opposite locations at opposite side portions of the peripheral edge 25 of the lid part 20. The interruptions extend from the peripheral edge 25 of the top portion 21 of the lid part 20 downwards in the height direction H into the side wall portion 22 of the lid part 20. The interruptions are optional features of the invention and may be omitted or a different number of interruptions from that which is shown in the figures may be used, such as one interruption, three interruptions or four interruptions. The interruptions may have any useful shape and size and may be provided only in the top portion 21 of the lid part 20.

The interruptions 60 may be used as separation means for facilitating gripping and separation of individual lid components 14 from a stack of lid components when applying the lid components to a container body in a production process for producing a packaging container as disclosed herein. The provision of separation means may be particularly useful when stacking lid components which fit snugly on each other with almost invisible separation lines between the stacked lid components.

As is shown in FIG. 6, the lower portion 32 of the connecting part 30 may form a continuation of the lid part side wall 22 and may fit on the lid component stacking step 51 with the lower portion 32 of the connecting part 30 flush with the lid part side wall 22, whereby the stack of lid components 14 is provided with a regular shape which may be beneficial when processing the lid components 14 in a packaging machine.

Any plastic component in the packaging container as disclosed herein may be formed from thermo-formable or moldable plastic materials, e.g. by injection molding. Injection molding is particularly suitable for producing plastic components having a three-dimensional structure, such as the lid component and the reinforcing rims disclosed herein.

It should be understood that the lid construction shown in the figures is optional to the packaging container of the claimed invention. In particular, the connecting part of the lid component may be arranged to be directly attached to a container body, without the optional upper reinforcing rim as disclosed herein or be removably attachable to an upper reinforcing rim which is permanently attached to the container body.

The invention claimed is:

1. A lid component for a paperboard packaging container said lid component having a lateral direction and a height direction perpendicular to said lateral direction, said lid component comprising a lid part and a connecting part said lid part comprising a top portion and a side wall portion, said top portion having an outer lid surface and an inner lid surface opposite to said outer lid surface and a peripheral edge surrounding said outer lid surface; and said connecting part comprising an upper portion and a lower portion in said height direction and having a lower edge surface, wherein stacking members are arranged on said outer lid surface, said connecting part being hingedly connected to said lid part, said connecting part being configured to remain hingedly connected to said lid part when said container is opened, said stacking members on said outer lid surface comprising a lid component stacking step and a container stacking step, said container stacking step comprising a first support surface arranged at a first level below an uppermost level of said outer lid surface in said height direction of said lid component and said lid component stacking step comprising a first support surface arranged at a second level below said uppermost level of said outer lid surface and below said first level in said height direction of said lid component, said lid component stacking step being arranged at said peripheral edge of said outer lid surface, outboard of said container stacking step in said lateral direction, said connecting part being adapted to fit on and be supported by said lid component stacking step, said container stacking step being adapted for receiving and supporting a bottom edge of a packaging container characterized in that said lid component comprises a locking arrangement said locking arrangement comprising mating locking elements, wherein a female locking element is arranged in said outer lid surface of said top portion of said lid part and a male locking element is arranged on a locking flap arranged on said connecting part and being hingedly connected to said connecting part by means of a live hinge formed integrally with said connecting part and said locking flap, wherein said lid component stacking step and said container stacking step extend across said locking flap, whereby said locking flap in a closed position with said mating locking elements being in mating engagement forms a part of said side wall portion of said lid part.

2. A lid component according to claim 1, wherein an inset gripping area is arranged in said outer lid surface of said top portion of said lid part, said inset gripping area being arranged at a free end portion of said locking flap which is positioned opposite said hinge and being arranged to provide access to said free end portion of said locking flap in a direction perpendicular to said height direction of said lid component.

3. A lid component according to claim 1, wherein said lid component stacking step and/or said container stacking step comprises one or more interruptions.

4. A lid component according to claim 1, wherein said first support surface of said lid component stacking step is arranged to support said lower edge surface of said lower portion of said connecting part, said lower edge surface being a lowermost edge surface of said lower portion of said connecting part.

5. A lid component according to claim 1, wherein said lid component stacking step and said container stacking step each comprises a second support surface, said second support surface of said lid component stacking step being arranged to support an inner wall of said lower portion of said connecting part.

6. A lid component according to claim 1, wherein said lid component stacking step and/or said container stacking step is arranged along 50% or more of the peripheral edge of said top portion.

7. A lid component according to claim 1, wherein said lid component stacking step comprises two interruptions arranged at opposite locations along said peripheral edge of said top portion.

8. A lid component according to claim 1, wherein a height of said second support surface of said lid component stacking step is from 0.3 millimetres to 7 millimetres as measured in said height direction of said lid component.

9. A lid component according to claim 1, wherein a height of said second support surface of said container stacking step is from 0.3 millimetres to 7 millimetres as measured in said height direction of said lid component.

10. A lid component according to claim 1, wherein a height of said lid component in said height direction of said lid component is from 5 millimetres to 50 millimetres.

11. A lid component according to claim 1, wherein said first support surface of said lid component stacking step has a width in said lateral direction of said lid component of from 0.5 millimetre to 5 millimetres.

12. A lid component according to claim 11, wherein said width of said first support surface of said lid component stacking step corresponds to a width of said lower edge surface of said lower portion of said connecting part in said lateral direction of said lid component.

13. A lid component according to claim 1, wherein said first support surface of said container stacking step has a width in said lateral direction of said lid component being from 1 millimetre to 10 millimetres.

14. A lid component according to claim 1, wherein said lid part is connected to said connecting part with a hinge.

* * * * *